United States Patent [19]

Kollenz

[11] Patent Number: 4,591,325

[45] Date of Patent: May 27, 1986

[54] APPARATUS FOR PRODUCING GAS-PERMEABLE PRESSED ARTICLES

[75] Inventor: Erich Kollenz, Leoben, Austria

[73] Assignee: Voest-Alpine Aktiengesellschaft, Linz, Austria

[21] Appl. No.: 756,083

[22] Filed: Jul. 17, 1985

[30] Foreign Application Priority Data

Jul. 18, 1984 [AT] Austria ..... 2330/84

[51] Int. Cl.[4] ..... B29C 3/02

[52] U.S. Cl. ..... 425/233; 425/237

[58] Field of Search ..... 425/233, 234, 237, 579, 425/470, 471

[56] References Cited

U.S. PATENT DOCUMENTS

| | | | |
|---|---|---|---|
| 874,167 | 12/1907 | Crow | 425/237 X |
| 2,964,791 | 12/1960 | McFarland | 425/233 X |
| 2,997,739 | 8/1961 | Smith et al. | 425/233 X |
| 3,450,529 | 6/1969 | MacDonald | 425/237 X |
| 3,907,485 | 9/1975 | Komarek | 425/237 X |
| 3,981,477 | 9/1976 | Armbrust et al. | 425/237 X |

FOREIGN PATENT DOCUMENTS

| | | |
|---|---|---|
| 1577229 | 4/1970 | Fed. Rep. of Germany . |
| 3129130 | 5/1982 | Fed. Rep. of Germany . |

*Primary Examiner*—J. Howard Flint, Jr.
*Attorney, Agent, or Firm*—Cushman, Darby & Cushman

[57] ABSTRACT

For the production of gas-permeable briquettes it is suggested to provide parts of the surfaces having higher porosity by performing the pressing operation in partial areas of the press surfaces against the material to be compressed. Press rolls (2), presses or briquette moulds, respectively, comprise depressions, grooves or blind bores (4), respectively, for receiving material to be pressed.

10 Claims, 8 Drawing Figures

FIG. 4
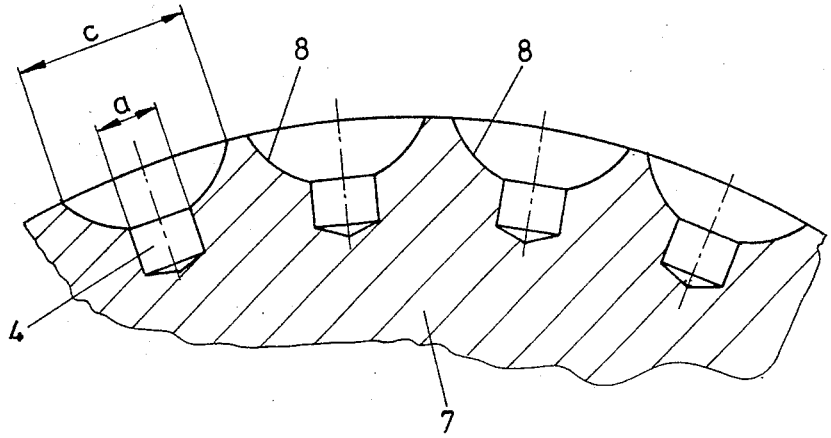
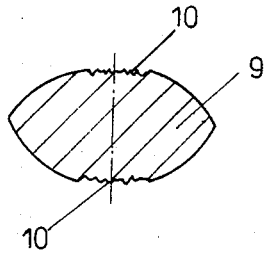
FIG. 5
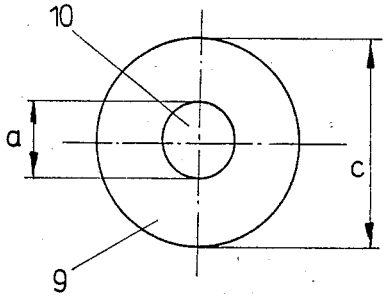
FIG. 6

APPARATUS FOR PRODUCING GAS-PERMEABLE PRESSED ARTICLES

The invention relates to apparatus for producing gas-permeable pressed articles such as barnacles, briquettes or the like. When pressing raw materials for subsequent metallurgical processing, there are, as a rule, formed particularly tight surfaces which offer a high resistance to reductive gases in subsequent reduction processes. Known barnacles and briquettes must partially again be disintegrated, i.e. be broken and sieved, for obtaining a correspondingly gas-permeable charge in a metallurgical process.

From DE-OS No. 15 77 229 it has already become known to extrude a sequence of segments into the shape of a continuous line, any segment thus just formed constituting a pressing surface for the subsequent segment. The counterpressure is obtained by the friction of the segment to be expelled. In this process, the whole surface becomes rough and the compressing pressure need not be selected too high for actually obtaining individual segments per se.

The invention now aims at obtaining, without reducing the strength properties, a higher gas-permeability and a less tight surface of the pressed articles already when producing pressed articles to be subsequently used as a charge in a metallurgical process. For solving this task, the invention essentially consists in that only part of the press surfaces are formed of layers consisting of the material to be compressed. On account of the pressing action being effected—over partial areas of the surface—not against the smooth surfaces of the press rolls or press moulds, respectively, but against areas having accummulated there the material to be compressed, there are formed, on the one hand, smooth areas distributed over the surface of the pressed articles and having been in shape-giving contact with the rolls or moulds, respectively, and, on the other hand, rough areas having their origin in their direct contact with the material to be compressed. These rougher areas are characterized by a surprisingly high gas-permeability, and pressed articles produced in this manner can without any subsequent mechanical treatment such as crushing and sieving directly be charged into a reduction process, noting that it could be observed that the reaction time could be shortened for approximately 30 percent. Such pressed articles of higher gas-permeability provide, in addition to the advantage of a shorter reduction time in a subsequent reduction process, also the advantage of a lower consumption of reductive gas on account of the more rapid throughput. The measure of partially compressing the pressed articles against the material to be compressed provides the additional advantage that the apparatuses used for performing this process are subject to a lower wear, thus increasing the effective life time of rolls or presses, respectively.

An apparatus particularly suitable for performing the process according to the invention is primarily an apparatus in which the surface of the rolls or presses or briquetting moulds is provided with depressions, in particular with grooves or blind bores, for receiving material to be compressed. Such rolls accummulate within their depressions or blind bores, respectively, the material to be compressed and thus provide a roughened surface at the area of the depressions or blind bores, respectively, this roughened surface forming on the pressed article an area of correspondingly increased gas-permeability. This measure simultaneously provides the advantage that the intake capacity of rolls is improved and that the wear of the rolls is reduced. For the purpose of producing pressed articles in the shape of briquettes, the inventive apparatus is essentially characterized in that the briquette moulds have recess means in the form of depressions and/or blind bores, the inside width of which is smaller than the inside width of the briquette moulds. Also in this case, material to be compressed is again accummulated within the depressions or blind bores, respectively, and is flush with the surface of the other pressing surfaces. By making flush said depressions or blind bores, there results, however, a surface of higher roughness than has the smooth surface of the rolls or the mould surface of the briquette moulds, and in this manner the gas-permeable areas of the briquettes are generated. For reliably obtaining permanently rougher areas of the surface within the press moulds, the depressions and/or blind bores are preferably designed such that they have an inside width of at least 3 mm and maximum 15 mm, preferably an inside width of 7 to 10 mm. For making sure that the material pressed into these blind bores or depressions, respectively, is not removed therefrom during each mould release step, the depth of the depressions is made at least 3 mm and preferably is selected smaller than the inside width of the depressions and/or blind bores or is selected equal said inside width.

A particularly high value of the gas-permeability of the pressed articles can be obtained if at the surface of the press moulds, such as rolls and/or briquette moulds, the proportion of the cross section occupied by the depressions or blind bores, respectively, is at least 30%, preferably 50 to 75%, of the total surface of the press moulds.

In the following, the invention is further explained with reference to the drawing showing embodiments of apparatuses suitable for performing the process according to the invention.

In the drawing

Figure 1:
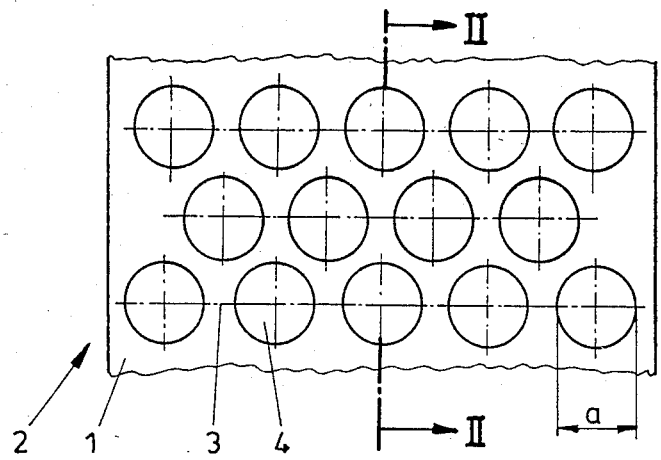
FIG. 1 shows a view of a roll for producing the pressed articles.
Figure 3:
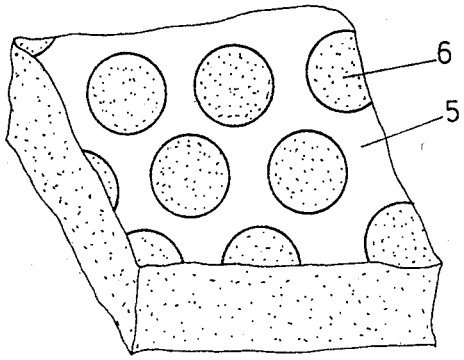
Figure 7:
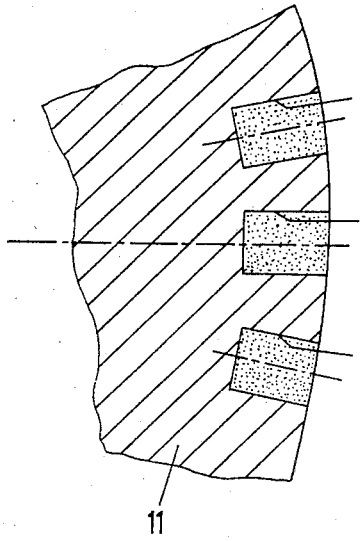
Figure 8:
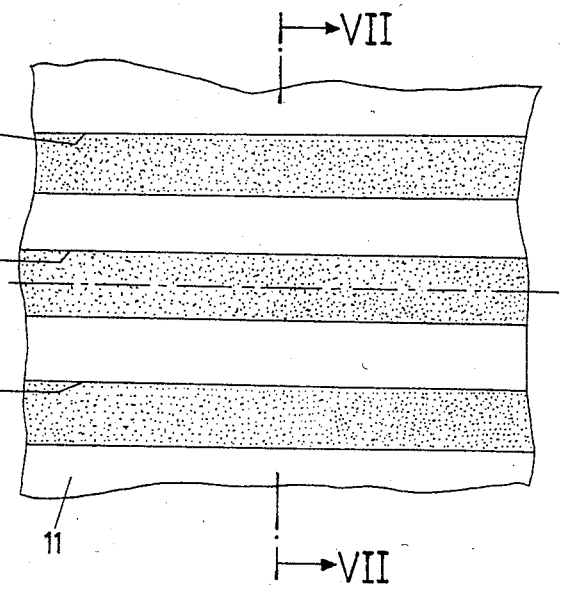

FIG. 3 shows a perspective partial view of a pressed article produced by means of a roll shown in FIG. 1, FIG. 4 shows a modified embodiment of a press mould for pressing briquettes, FIG. 5 shows a cross section through a briquette having been pressed with an apparatus according to FIG. 4, FIG. 6 shows a plan view of a briquette shown in FIG. 5, FIG. 7 shows in a partial cross section along line VII—VII of FIG. 8 a modified embodiment of a press roll and FIG. 8 shows a view of the roll according to FIG. 7.

Figure 2:
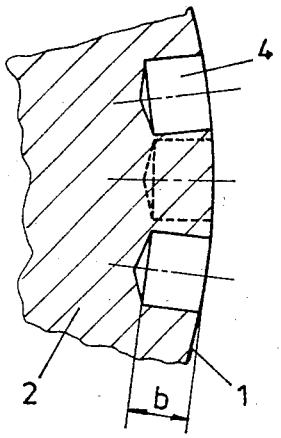
FIG. 2 shows a section along line II—II of FIG. 1.

In FIG. 1, there is shown the mantle 1 of a roll 2, which mantle is provided with blind bores 4 having their center points aligned in direction of the generatrices 3 of the mantle. As can be taken from FIG. 2, the blind bores 4 have a depth essentially corresponding to the diameter a, the diameter a having a value of approximately 10 mm. The depth of the blind bores carries the reference character b in FIG. 2.

When mounting two moulds shown in FIG. 1 within a roll stand and when adjusting a corresponding roll gap between two such rolls, there can be produced a pressed article of the type shown in FIG. 3. The pressed article 5 comprises partial areas 6 corresponding to the blind bores 4 of the rolls 2 and having a higher gas-permeability than the remaining portions—remaining between said partial areas 6—of the surface of the pressed articles 5. The plate-like pressed articles are crushed prior to being used as a charge in a metallurgical process.

In the embodiment according to FIG. 4, there is again shown a roll 7 which now comprises moulds 8 for pressing briquettes. On the bottom of the moulds 8 for pressing briquettes, there are again arranged recess means in the form of blind bores 4 having a smaller diameter a than is the diameter c of the moulds 8 for pressing the briquettes. Material to be compressed is again accummulated within the blind bores 4 and this results in a roughened surface at the bottom of the moulds 8. In FIGS. 5 and 6 are shown the briquettes which can be produced by means of a roll 7 shown in FIG. 4. The roughened surface area having a higher gas-permeability and corresponding to the blind bores 4 is designated 10 in such briquettes 9.

The diameter a of the bores 4 is, in this case, to be dimensioned such that the briquettes or pressed articles, respectively, can be detached, noting that the material to be pressed, is being broken at the front end of the bores. The area of fraction is then characterized by a particularly high gas permeability.

In the embodiment according to FIGS. 7 and 8, the press surface of the rolls 11 has grooves 12 extending in direction of the generatrices of the mantle surfaces. The width of the grooves 12 corresponds, as measured in circumferential direction, essentially to the diameter a of a blind bore 4 illustrated in FIGS. 1 and 2.

What is claimed is:

1. Apparatus for producing gas-permeable pressed articles comprising opposed mold elements having opposed mold cavity means, the mold cavity means having surfaces which are provided with blind recess means the inner width of which is smaller than the inner width of the mold cavity means so that the recess means form areas of the pressed articles which are more gas permeable than the areas of the pressed articles which are formed by the surfaces of the mold cavity means.

2. Apparatus as in claim 1 wherein the recesses are grooves.

3. Apparatus as in claim 1 wherein the recesses are blind bores.

4. Apparatus as in claim 1 wherein the recesses have an inner width of at least 3 mm and a maximum of 15 mm.

5. Apparatus as in claim 1 wherein the recesses have an inner width of at least 7 mm and a maximum of 10 mm.

6. Apparatus as in claim 1 wherein the depth of the recesses is at least 3 mm.

7. Apparatus as in claim 6 wherein the inner width of the recesses is the same as the depth of the recesses.

8. Apparatus as in claim 6 wherein the inner width of the recesses is less than the depth of the recesses.

9. Apparatus as in claim 1 wherein the proportion of the cross-section of the mold cavities occupied by the recesses is at least 30% of the total surface of the mold cavities.

10. Apparatus as in claim 1 wherein the proportion of the cross-section of the mold cavities occupied by the recesses is 50 to 75% of the total surface of the mold cavities.

* * * * *